United States Patent [19]

Nordstrom et al.

[11] Patent Number: 4,828,081

[45] Date of Patent: May 9, 1989

[54] LUGGAGE IDENTIFICATION SYSTEM

[75] Inventors: Mark B. Nordstrom, Evergreen, Colo.; Guenther E. Patzelberger, Naucalpan, Mexico

[73] Assignee: Samsonite Corporation, Denver, Colo.

[21] Appl. No.: 164,049

[22] Filed: Mar. 4, 1988

[51] Int. Cl.[4] ..... A45C 13/28; A45C 13/42

[52] U.S. Cl. ..... 190/102; 190/115; 190/125; 40/6

[58] Field of Search ..... 40/6; D20/43; D3/77, D3/76; 190/100, 102, 115, 125, 127, 39

[56] References Cited

U.S. PATENT DOCUMENTS

| | | | |
|---|---|---|---|
| D. 202,973 | 11/1965 | Field | D20/43 X |
| D. 246,590 | 12/1977 | Sollazzi | 190/100 X |
| D. 246,591 | 12/1977 | Sollazzi | 190/100 X |
| D. 256,966 | 9/1980 | Iszler | D3/76 X |
| D. 294,084 | 2/1988 | Gibbs | D3/76 X |
| 1,039,902 | 10/1912 | Cook | 190/102 X |
| 1,277,785 | 9/1918 | Urband | 190/102 |
| 1,481,182 | 1/1924 | Brooks | 190/102 X |
| 1,767,573 | 6/1930 | Braunstein | 190/102 X |
| 3,999,639 | 12/1976 | Walters | 190/102 |
| 4,616,435 | 10/1986 | Perfect | 40/6 |

FOREIGN PATENT DOCUMENTS

| | | | |
|---|---|---|---|
| 446009 | 4/1936 | United Kingdom | 190/102 |
| 527699 | 10/1940 | United Kingdom | 190/102 |
| 683992 | 12/1952 | United Kingdom | 190/102 |

OTHER PUBLICATIONS

"System 4" Product Brochure #FM-0187-285-AG-S-PHS-SF-PRF, Samsonite Corp., copyright 1985.

"Regiment II" Product Brochure #FM-0161-12-84-AGS-PHS-SF-PRF, Samsonite Corp., 1984.

"Silhouette III" Product Brochure #8334 Samsonite Corporation, copyright 1983.

*Primary Examiner*—Sue A. Weaver

*Attorney, Agent, or Firm*—Gregory W. O'Connor

[57] ABSTRACT

Various systems have been proposed for providing personal identification information in conjunction with luggage pieces. Recently there has been concern that such personal identifying information should not be broadly or notoriously displayed. Thus, I.D. tags having a flap covering this personal identification information have been offered to the public. Information on such tags still can be relatively easily viewed, and the tags can become lost or pulled off of the luggage through ordinary baggage handling. The disclosed system includes an identification panel which is flush with a panel of the luggage and is normally protected by the luggage construction itself, specifically a web tangent to and affixed permanently to the outer covering of that luggage panel. The identification panel includes an elastic member which holds the identification panel against all but determined intentional effort to withdraw the panel from underneath the web. Once the withdrawal force is removed, the panel immediately is withdrawn to its protected and almost invisible position beneath the web. In this way, unintentional viewing of the personal identification information is generally prevented, as is the unintentional loss of the identification panel and the information thereon.

9 Claims, 1 Drawing Sheet

LUGGAGE IDENTIFICATION SYSTEM

BACKGROUND OF THE INVENTION

The subject invention relates to the field of luggage, specifically, soft-sided luggage construction comprising a lamination or layering of a stiffening member and outside covering having a web attached to the outside of the fabric covering. More specifically, it relates to such a luggage construction which incorporates a deployable identification panel which can selectively display identifying information and alternately store the identification panel in a manner so that the identifying information is not readily visible from outside the luggage case.

There have been many prior luggage constructions which have provided for holding and displaying identifying information. Two such devices are shown in U.S. Pat. Nos. Des. 281,436 and 281,706, assigned to Samsonite Corporation, the assignee of this invention. Other identifying systems have included tags attached to the handle or some other attachment point on the luggage case. These tags include a transparent window through which the identifying information may be viewed. Some tags have included an opaque covering or flap which obscures the transparent window until folded back.

In recent years, there has been a concern about displaying identifying information in an open and notarious manner on luggage cases. Such identifying information often includes personal information about the traveler. When such luggage cases are checked during travel on public transportation, such as on buses, airplanes and trains, the traveler has no control over who views this personal information, and thus, a traveler's valid desire for anonymity during traveling has been compromised.

Accordingly, it is an aim of the instant invention to provide a luggage construction which securely attaches the identifying information to the luggage piece and prevents its inadvertent loss, while simultaneously limiting access to this identifying information by unauthorized persons.

BRIEF SUMMARY OF THE INVENTION

This invention comprises a luggage construction for selectively displaying identifying information on an identification panel. The construction comprises a luggage panel and a layer of material (an overlapping layer of material with a free edge or a strip of webbing) affixed to the luggage panel on the covering of that panel. The covering has an opening approximate to one edge of that layer of material. An elastic member passes beneath the covering with the identification panel attached to an end of this elastic member. The identification panel is positioned at least in part between the portion of the layer of material adjacent that opening in the covering such that in the normal position, the identifying information on the identifying panel is concealed beneath the layer of material near its free edge, and in a deployed condition at least more of the identification panel can be withdrawn from beneath the material against a biasing force provided by the elastic member. In this manner, identifying information may be selectively displayed.

Preferably, the layer of material beneath which the identifying panel is deployed is part of a loop of webbing material, and the loop extends substantially the entire lateral dimension of the panel on the luggage piece. A portion of the webbing loop may be formed into a handle and the web portion beneath which the identifying panel is positioned may be positioned beneath that handle formed by the web loop.

Other features and aspects of the invention, as well as the invention's various benefits, will become clear in the detailed description of the preferred embodiment which follows.

DETAILED DESCRIPTION OF THE PREFERRED EMBODIMENT

Figure 1:
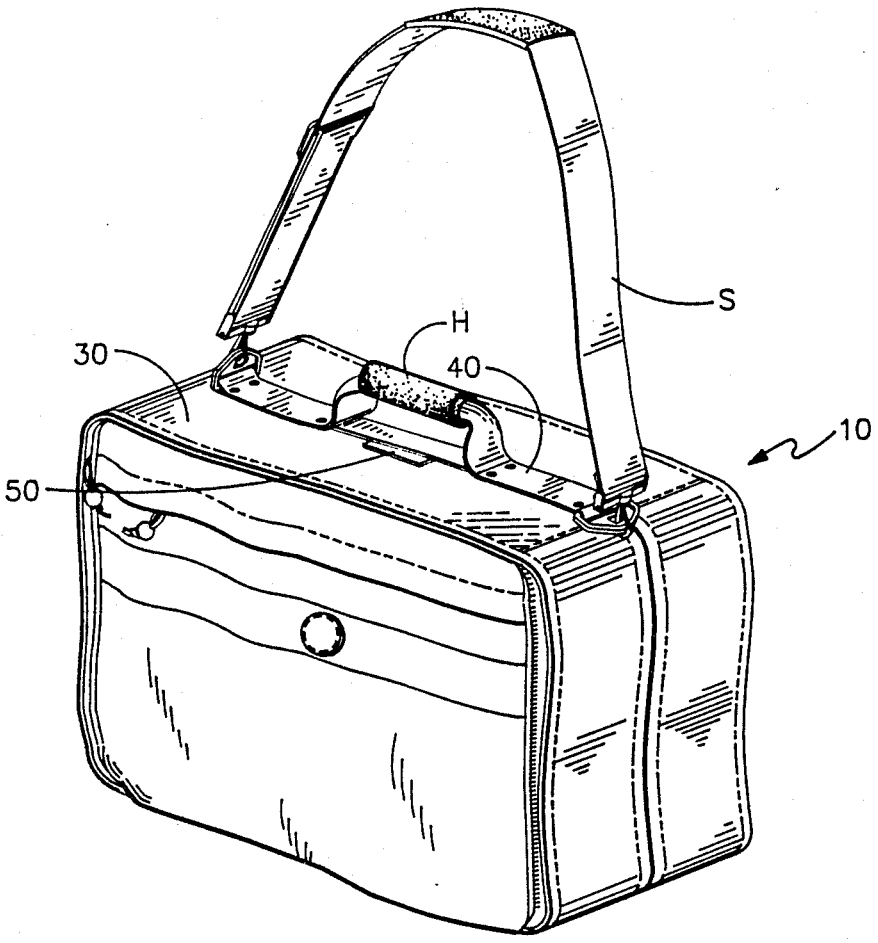
FIG. 1 is a perspective view of a luggage case incorporating the identification system.

FIG. 1 shows a perspective view of a luggage case embodying the instant invention. The luggage case 10 is preferably in a generally rectangular shape and includes a panel construction 30 which in this case is shown to be the upwardly facing facet of the generally rectangular box-like shape of the luggage case 10.

A webbing loop 40 is shown extending along the longest most dimension of the panel 30 to which is attached a shoulder strap S in a manner which will be detailed below. Also shown is a handle H positioned centrally of the panel 30 and the overall luggage case 10. An edge of an identifying panel 50 is shown projecting beneath a central portion of the web loop 40. In the preferred embodiment, the identification panel 50 is positioned beneath the handle H, although it may be positioned elsewhere on the luggage case; for example, to either side of the handle H beneath a portion of the web loop 40.

Figure 2:
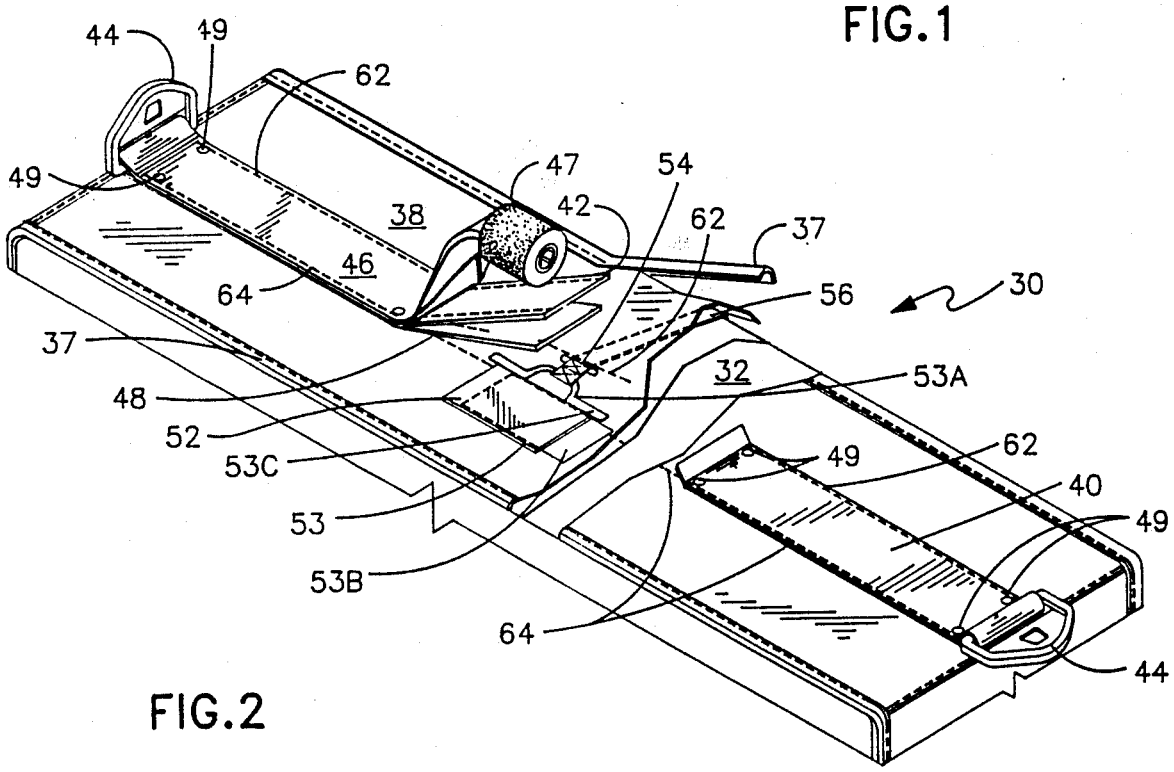
FIG. 2 is a detail of a portion of FIG. 1, with portions of the construction broken away.

FIG. 2 shows an exploded view of the top panel or top rail 30 of the luggage case. The core of the top panel comprises a stiffening layer 32 which may be an extruded plastic sheet with a spring steel stiffening member underneath (not shown) for added rigidity, or an extruded plastic honeycomb structure. For aesthetic reasons, the inner surface of the stiffening layer is covered with a cloth liner (also not shown). The outer surface of the top panel 30 is covered with a covering material 38 which continues around the other side and bottom panels as a continuous sheet or in sections as is conventional in luggage art. The front panel and side rails of the case, the covering material 38 and the liner are sewn together at the longitudinal edges of the top panel using an edge binding 37.

A loop of webbing 40 is sewn to the covering material 38 along the edges of the webbing across the longitudinal dimension of the top panel and to its lateral edges. This web loop 40 may include a strip of accent material 42, the edges of which project from between the two layers of webbing which form the web loop 40. At the opposite ends of the web loop 40 near the lateral edges of the panel 30 are positioned D-rings 44 for receiving clips attached to opposite ends of the shoulder strap S. The upper portion 46 of the web loop 40 includes an extra length of webbing which projects a substantial distance above the upper surface of the top panel 30. Portion 46 passes through a tubular handgrip 47, which is positioned centrally of the top panel 30 to form a handle H. The accent material 42 is shown separated from upper portion 46 for clarity. It is preferred that the accent layer is stitched continuously to the upper layer and passes through the tubular handgrip 47 along with the upper layer 46.

The lower layer 48 of the web loop 40 is positioned adjacent to the covering material 38 for its entire length. Except for the portions immediately adjacent the identification panel 50, the lower layer 48 as well as the overlapping portions of the upper portion 46 are stitched directly to the covering material 38. The resulting combination of covering material and those portions of the web loop 40 are adhered directly to the sandwich of the stiffening materials 32 to form an integral unit.

As previously stated, an object of the invention is to provide a means of containing the personal information of the owner of the luggage and yet have that personal information not readily accessible by the casual observer. These objects are accomplished by positioning a deployable I.D. holder 52 beneath the central portion of the lower layer 48 of the web loop 40. Approximate the first stitching line 62 which holds the layer 48 down is a slot 54 through the covering material 38. The slot 54 is normally hidden beneath web layer 48, but is shown exposed in this exploded view. Through this slot passes elastic member 56 which extends between the covering 38 and the stiffening panel 32 to approximately the edge portion where the binding 37 is. The elastic member 56, which is preferably a loop of ordinary elastic webbing of known type, has its one end affixed to the stiffening panel. This may be accomplished by sewing the elastic member 56 to the top rail 30 along the rear longitudinal edge prior to binding the edge. Other means such as gluing, riveting, etc. could be used also. It is important that there be enough of the elastic member 56 free so that in its extended condition the elastic member can extend from its fixed end at the stiffening panel edge to the upper edge of the I.D. panel 52 when the upper edge of that panel is pulled to a position adjacent the second stitching line 64. The first stitching line 62 stops on either side of the slot 54 so as to permit the elastic member to extend substantially unimpeded from underneath the covering layer 38 through the slot 54. In like manner, the second stitching line 64 is interrupted to permit the I.D. panel 52 to project from underneath the webbing layer 48 through that interruption. Thus, the webbing layer 48 presents a layer of material having a free edge beneath which the I.D. panel is deployed.

The I.D. panel 52 comprises a clear plastic envelope 53, having an opening for receiving an ordinary card 53B having identifying information thereon. At its upper edge, there is positioned a reinforced opening 53A through which passes the loop of the elastic member 56. Optionally, the envelope 53 includes laterallyextending ears 53C. These ears function to limit how far the I.D. panel can be withdrawn from beneath the web 48 against the biasing force of the elastic member 56 when the information on the card 53B is being viewed. Alternatively, the ears 53C may be eliminated. It has been found that elastic member 56 can be sized and pre-stretched such that it reaches its limit of stretch just before the upper edge of the envelope 53 passes the second stitching line 64. In this way unintended complete withdrawal or removal of the envelope 53 can be avoided without the ears 53C.

To further increase the ability of the upper panel to transmit the lifting forces provided by the D-rings 44, and the tubular handgrip 47, it has been found desirable to provide several rivets 49 approximate those D-rings and the handle. These rivets pass through not only the web loop 40 at those points, but through the stiffening panel 32 also.

Thus, it can be seen that the subject invention provides a simple, strong upper panel for supporting a piece of luggage from a handle or a shoulder strap, while simultaneously providing a simple and aesthetically pleasing construction for holding an identification card.

While a preferred embodiment of the invention has been described, changes to details of this embodiment can be made without departing from the true scope of the invention as set forth in the following claims:

We claim:

1. A luggage construction for selectively displaying an identification panel on a piece of luggage comprising a luggage panel, said luggage panel including a stiffening layer, a layer of material with a free edge affixed to said stiffening layer, an identification panel having identifying information thereon being positioned at least in part between the said layer of material and said stiffening layer, such that in its normal position said identifying information is concealed beneath said layer of material at said free edge, means for providing a biasing force to said identification panel, said biasing force resisting withdrawal of said identification panel from beneath said layer of material, such that in its deployed condition at least more of said identification panel is withdrawn from beneath said layer of material against said biasing force, whereby said identifying information may be selectively displayed.

2. A luggage construction as set forth in claim 1 wherein said layer of material is a web.

3. A luggage construction as set forth in claim 2 further including a handle for said luggage and wherein said web is positioned beneath said handle.

4. A luggage construction as set forth in claim 2 wherein said luggage panel includes a covering over said stiffening layer and beneath said web, an opening in said covering beneath said web, said means for providing a biasing force comprises an elastic member which passes beneath said covering and through said opening, and wherein said stiffening layer includes an edge, and said elastic member extends beneath said covering from approximate said opening to said edge, and wherein said elastic member is affixed to said layer approximate said edge.

5. A luggage construction as set forth in claim 2 wherein said web is formed into a loop having lateral ends, said luggage panel having a lateral dimension defined by lateral edges and said loop extending substantially entirely said lateral dimension of said panel.

6. A luggage construction as set forth in claim 5 wherein said loop includes means for holding attachment hardware thereto approximate said lateral ends of said loop and near said lateral edges of said panel, and wherein said loop further includes an upstanding portion positioned above said identification panel, said upstanding portion including handgrip means for forming a handle.

7. A luggage construction as set forth in claim 6 wherein said means for forming a handle comprises a generally tubular member through which a portion of said upstanding portion of said web passes.

8. A luggage construction as set forth in claim 1 wherein said identification panel comprises a transparent plastic envelope, said envelope including means for attaching said means for providing a biasing force approximate one edge thereof, a removable card positioned within said envelope for displaying said identifying information, whereby said envelope can be withdrawn against said biasing force and said identifying information may be entered on said card.

9. A top panel for a luggage case, said top panel having a lateral dimension defined by lateral edges, comprising, a stiffening member extending the full length and width of said top panel, a covering material for covering the upper surface of said stiffening member, said covering material including an opening for access between said stiffening member and said covering material, a length of webbing material extending the length of said top panel, said length of webbing material including oppositely positioned ends approximate the lateral edges of said panel, said ends including means for attaching a shoulder strap thereto, said length of webbing material including a central portion comprising an upper webbing layer and a lower webbing layer, said upper layer passing through a tubular handle construction, said lower layer being approximate to and tangent to said covering material, at least some of said central portion of said lower webbing layer being unattached to said covering material, an identification panel being normally positioned between said lower webbing layer and said covering material at said central portion, an elastic member normally positioned between said stiffening member and said covering material, a first end of said elastic member fixed to said stiffening member, a second end of said elastic member being attached to said identification panel, said identification panel and said elastic member in combination being positioned so that when said identification panel is withdrawn against the elastic force of said elastic member, a portion of the combination of the said identification panel and said elastic member passes through said opening through said covering material, whereby said identification panel is normally positioned between said lower layer and said covering material and identifying information carried by said identification panel cannot be viewed, and in its withdrawn condition, the identification panel projects a substantial distance from between said lower layer and said covering material so that the identifying information can be easily read.

* * * * *